United States Patent [19]

Geraci

[11] Patent Number: 4,925,241

[45] Date of Patent: May 15, 1990

[54] CUSHION FOR SPORTING EVENTS

[76] Inventor: Ronald J. Geraci, 62000 Schoenherr, Washington, Mich. 48094

[21] Appl. No.: 725,646

[22] Filed: Apr. 22, 1985

[51] Int. Cl.[5] ..... A47C 27/00

[52] U.S. Cl. ..... 297/229; 297/218; 297/219; 5/420

[58] Field of Search ..... 297/218, 219, 223, 229, 297/382; 5/417, 420, 466; 206/326; 150/52 R, 52 F

[56] References Cited

U.S. PATENT DOCUMENTS

| | | | |
|---|---|---|---|
| 2,432,365 | 12/1947 | Allen | 150/52 R |
| 2,480,402 | 8/1949 | Elston . | |
| 2,734,556 | 2/1956 | Hebrank | 297/219 X |
| 2,843,185 | 7/1958 | Clem et al. . | |
| 2,865,433 | 12/1958 | Warner | 297/218 |
| 3,098,315 | 7/1963 | Bono | 150/52 R X |
| 3,143,748 | 8/1964 | Manning | 5/420 |
| 3,185,362 | 5/1965 | Wakefield . | |
| 3,222,694 | 12/1965 | Schick | 297/219 X |
| 3,314,464 | 4/1967 | Veilleux | 150/52 R |
| 3,323,151 | 6/1967 | Lerman | 5/420 X |
| 3,336,610 | 8/1967 | Geddings | 5/420 |
| 3,659,297 | 5/1972 | Schutz | 297/219 X |
| 3,879,775 | 4/1975 | Iwata | 5/420 X |
| 4,026,339 | 5/1977 | Burke | 150/52 R X |
| 4,190,918 | 3/1980 | Harvell | 297/219 X |

FOREIGN PATENT DOCUMENTS

| | | | |
|---|---|---|---|
| 782695 | 6/1935 | France | 297/382 |
| 290831 | 5/1953 | Switzerland | 5/345 |
| 492494 | 9/1938 | United Kingdom | 5/466 |

*Primary Examiner*—Laurie K. Cranmer

*Attorney, Agent, or Firm*—Harness, Dickey & Pierce

[57] ABSTRACT

A portable cushion apparatus is described as generally comprising a pair of cushions which are joined together by a flexible hinge at one end which permits a variety of seating configurations. Each of the cushions comprise a flexible enclosure having a resilient material contained therein. The flexible hinge is provided with a handle for facilitating the carrying of the cushion apparatus. An elastic strap is attached to opposite sides of the back surface of at least one cushion which may be used to surround the associated portion of a chair thereby retaining the portable cushion apparatus in a selected position. A Velcro fastener is also provided to releasably join together the two cushions at generally the end opposite to the flexibe hinge. In the alternative of Velcro fastener the elastic strap may be used to suround both cushions thereby releasably joining them together.

8 Claims, 2 Drawing Sheets

CUSHION FOR SPORTING EVENTS

BACKGROUND OF THE INVENTION

The present invention relates generally to cushions, and particularly to a portable cushion apparatus which is especially useful at sporting events.

For reasons of durability, maintenance and cost, many of the seats and stairs installed in stadiums, arenas and the like are provided with hard surfaces. Yet, many of the spectator events at these places can typically last for several hours. Accordingly, these hard surfaces can cause discomfort to the viewer and detract the viewer's enjoyment of the event. There are, of course, numerous other types of chairs, localities and situation in which it would be desirable to provide cushioning for an individual.

Therefore, it is a principal object of the present invention to provide a portable cushion apparatus.

It is a more specific object of the present invention to provide a portable cushion apparatus which is versatile, economical and easy to handle.

It is another object of the present invention to provide a portable cushion apparatus which is durable, compact, lightweight and comes in a see-through dust cover for convenient storage.

It is a further object of the present invention to provide a portable cushion apparatus which is weather and water resistant.

It is an additional object of the present invention to provide a portable cushion apparatus upon which a variety of colorful imprints can be displayed.

It is yet another object of the present invention to provide a portable cushion apparatus which can be used for one or two persons.

It is yet a further object of the present invention to provide a portable cushion apparatus which can be utilized with both benches and

SUMMARY OF THE INVENTION

To achieve the foregoing objects, the present invention provides a portable cushion apparatus which generally comprises a pair of flexible enclosures each having a resilient material disposed therein, flexible means for joining together the fabric enclosures at generally one end thereof, and handle means connected to the flexible means for facilitating the carrying of the cushion apparatus. In accordance with one feature of the present invention, the flexible enclosures and the flexible means are both made of a fabric, such as a nylon-like weave fabric and the resilient material is an elastomeric foam pad. The flexible means permits the two flexible enclosures to be positioned in a variety of ways. For example, the flexible enclosures may be positioned at a right angle with respect to each other, or they may be laid out flat so that two persons can be provided with a cushion.

In accordance with a second feature of the present invention, the rear surface of at least one flexible enclosure has an elastic strap attached generally at the end opposite to the flexible means, which may be used to surround the associated portion of the seat, thereby retaining the portable cushion apparatus in a selected position for use.

In accordance with another feature of the present invention, hook and loop fastener means is provided for releasably joining together the flexible enclosures at generally the end opposite to the flexible means. This feature gives the portable cushion apparatus a certain compactness which is particularly advantageous when the apparatus is being carried from one place to another.

Additional advantages and features of the present invention, such as various re-closable openings and a dust cover, will become apparent from a reading of the detailed description of the preferred embodiments which make reference to the following set of drawings in which:

DETAILED DESCRIPTION OF THE PREFERRED EMBODIMENTS

Figure 1:
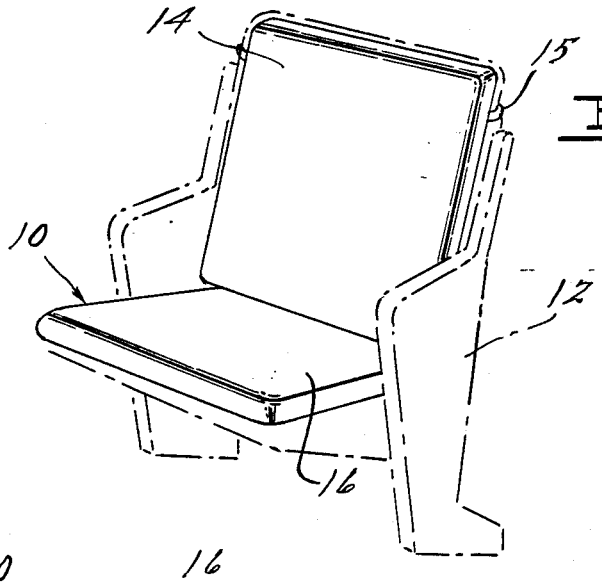
FIG. 1 is a perspective view of a portable cushion apparatus according to the present invention which is positioned for both seat and back support in a typical grandstand chair.

Referring to FIG. 1, a perspective view of a portable cushion apparatus 10 according to the present invention is in connection with a typical stadium or grandstand chair 12. The cushion apparatus includes a pair of cushions 14 and 16 which may be arranged in a variety of different positions with respect to each other. Thus, for example, in FIG. 1 the cushion 14 is arranged for back support, while the cushion 16 is arranged for seat support. As will be appreciated from the description of the figures below, one of the cushions may be placed in a horizontal position, while the other cushion is placed in a vertical position, thereby forming a right angle between the two cushions.

Figure 2:
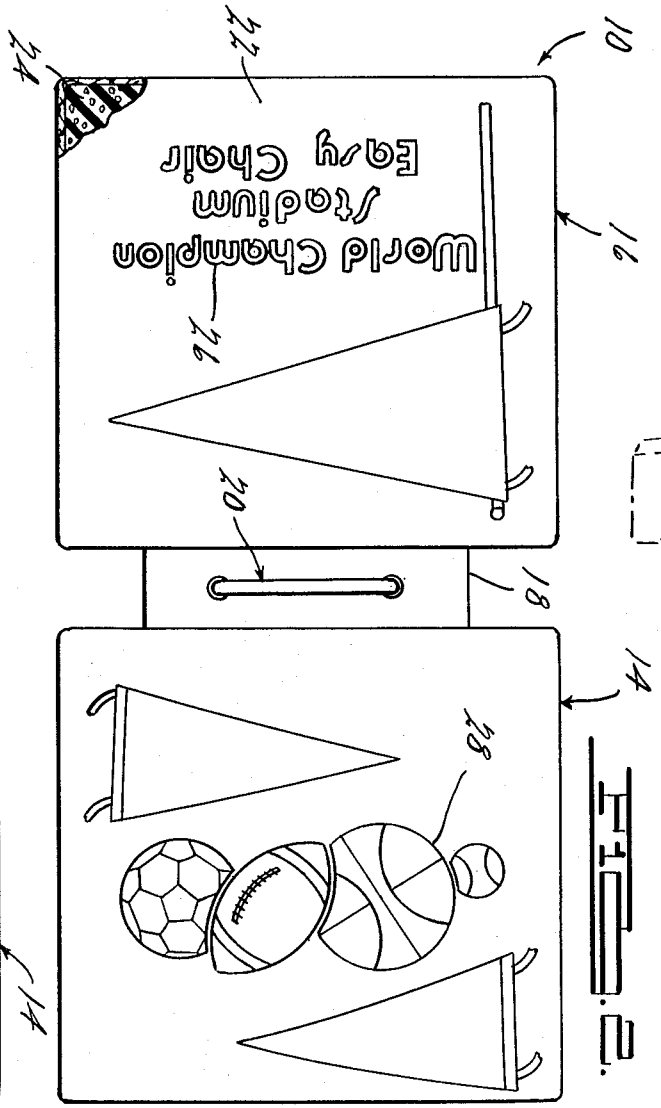
FIG. 2 is a front elevation view of the portable cushion apparatus with one end cut-a-way in order to show the elastomeric foam pad therein.

Referring to FIG. 2, a front elevation view of the portable cushion apparatus 10 is shown. The cushion apparatus 10 is shown to be comprised of the two cushions 14 and 16, a piece of flexible material 18 which joins together the cushions at generally one end thereof, and a handle 20 for facilitating the carrying of the cushion apparatus 10. Each of the cushions 14 and 16 are generally comprised of a flexible enclosure 22 which provides a covering for a resilient material 24 disposed therein. The resilient material 24 is shown at the one end of the cushion 16 which is cut-a-way for illustration purposes.

In accordance with one embodiment of the present invention, both the flexible enclosures 22 and the piece of flexible material 18 are made cf fabric. Preferably, this fabric should be a weather and water resistant fabric, such as a synthetic weave produced by DuPont and generally referenced by the trademark DENIER CORDURA. Similarly, in one embodiment of the present invention, the resilient material 24 comprises a pad of elastomeric foam material. However, it should understood that other suitable materials for the flexible enclosures 22, the piece of flexible material 18, and the resilient material 24 may be employed in the appropriate application. Thus, for example, it may be desirable to make the flexible enclosures 22 out of leather, vinyl, plastic or canvas. It may also be desirable to provide flexible enclosures in a variety of colors. Additionally, any number of resilient materials may be employed within the principels of the present invention, including combinations of resilient materials. It may also be possible to employ an inflatable bladder for the resilient material, which would reduce the shipping size of the cushion apparatus.

It should also be noted that the shape of the cushions 14 and 16 may be varied as desired. Thus, while a generally rectangular surface area is shown in FIG. 2, it may be desirable in the appropriate circumstances to provide cushions having a rounded contour. It will also be understood by those skilled in the art that the flexible enclosures 22 should generally be form fitted with the type and size of the resilient material 24 in order to provide a smooth exterior surface for the cushions. Thus, for example, with the resilient material 24 being an elastomeric foam pad having a generally rectangular cross sectional area, the flexible enclosure 22 should be formed or sewn to have a generally rectangular cross sectional area.

FIG. 2 also illustrates that one or more of the cushions 14 and 16 may be provided with a variety of colorful imprints. Thus, for example, lettering may be provided, such as indicated at the reference numeral 26. Similarly, graphical displays may also be provided, such as indicated by the reference numeral 28. Accordingly, it will be at insignia, names, and/or company logos may be displayed as desired. These imprints may be in single or multicolors, and conventional silkscreening may be utilized to apply these imprints to the cushions.

Figure 3:
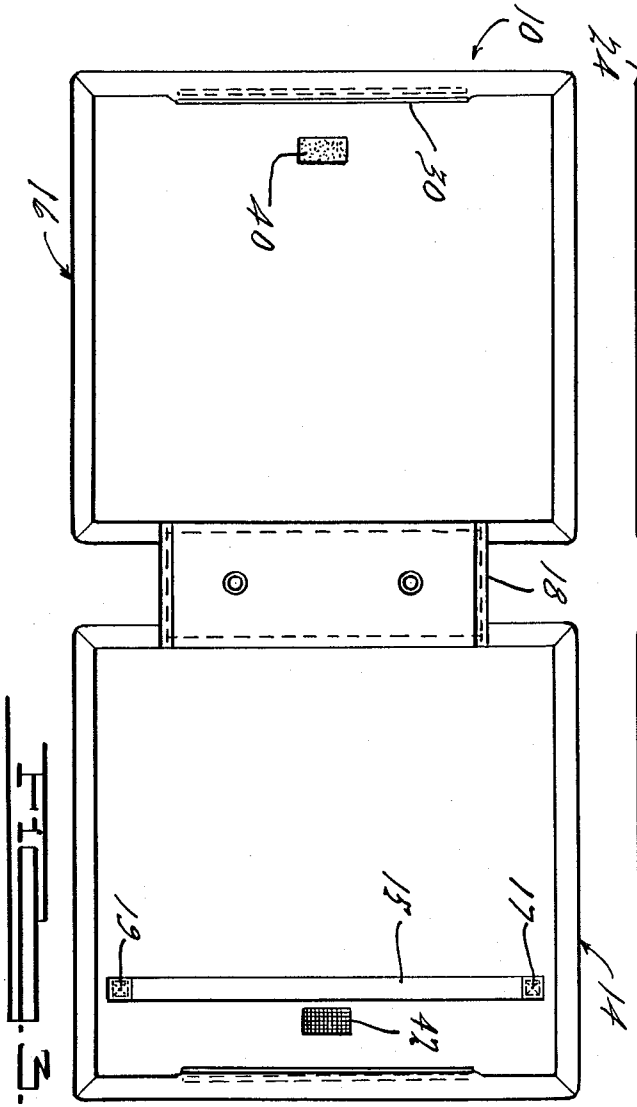
FIG. 3 is a rear elevation view of the portable cushion apparatus shown in FIG. 2.

Referring to FIG. 3, a rear end elevation view of the portable cushion apparatus 10 is shown. This figure illustrates that a re-closable opening 30 may be provided to each of the cushions 14 and 16 along one of their sides. These re-closable openings will facilitate the stitching of the fabric covers, as will as the insertion or removal of the resilient material 24.

Figure 9:
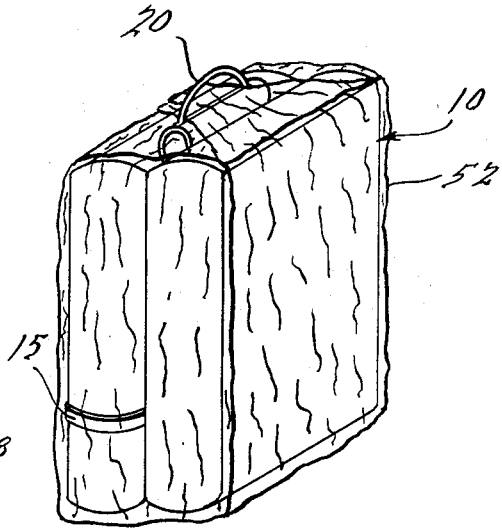
FIG. 9 is a perspective view of a portable cushion apparatus according to the present invention which is contained in a see-through dust cover.

Also shown is an elastic strap 15, attached to the rear surface of a cushion 14 generally at the end opposite the flexible material 18 at points 17 and 19. The elastic strap 15 may be used to releasably secure the portable cushion apparatus 14 to seat 12 as best shown in FIG. 1. The elastic strap 15 may also be used in lieu of Velcro fasteners 40–42 to releasably secure together the back surfaces of the cushions 14 and 16 while the apparatus of the present invention is stored or carried from one place to another as seen in FIG. 9.

Figure 4:
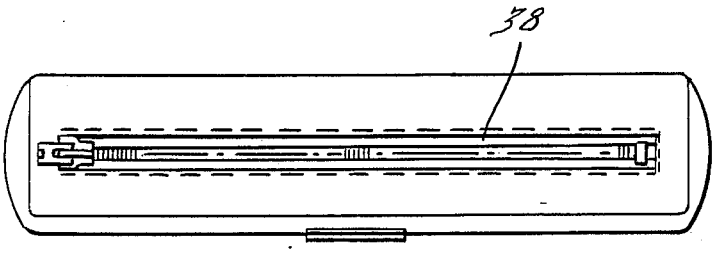
FIG. 4 is an end view of a portable cushion apparatus according to the present invention which features a zipper re-closable opening along one side.
Figure 5:
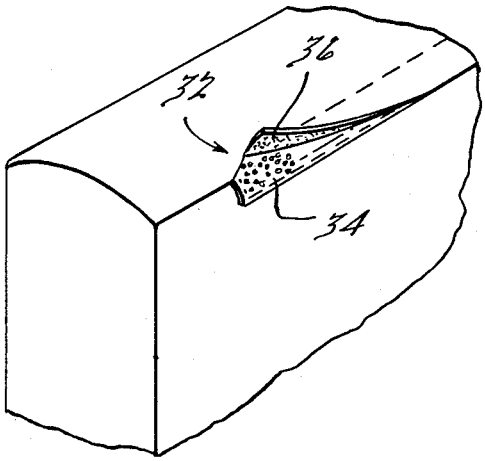
FIG. 5 is a partial perspective view of a portable cushion apparatus according to the present invention which features a Velcro re-closable opening along one side.

As shown in FIGS. 4 and 5, the re-closable openings 30 may be comprised of a fastener or a zipper. FIG. 5 particularly illustrates the use of a Velcro fastener 32. This type of fastener generally comprises a strip of flexible hooks 34 and an opposing strip of flexible loops which are each seen onto the fabric cover. Accordingly, it will be appreciated in this embodiment the sewing of the fabric cover should be such that part of the fabric cover provides a flap over location where the the two Velcro strips are joined together. FIG. 4 particularly illustrates an embodiment which employs a zipper 38. As shown in FIG. 4 the zipper extends along one end of the cushion. However, other suitable locations for the zipper 38 or the Velcro fastener 32 may be provided.

Referring again to FIG. 3, the piece of flexible material 18 is shown to be seen at its opposite ends to one end of each of the cushions 14 and 16. While the piece of flexible material 18 is shown to have a generally rectangular shape, it should be appreciated that other suitable shapes may be employed in the appropriate application. However, it is important that the width of the piece of flexible material 18 be such as to permit the cushions 14 and 16 to be positioned in a generally right angle with respect to each other. Thus, the piece of flexible material 18 acts as a hinge between the two cushions 14 and 16. It should also be noted that while the piece of flexible material 18 is shown to be sewn to the cushions 14 and 16, other suitable fastening means could be provided, such as Velcro fastener.

Figure 6:
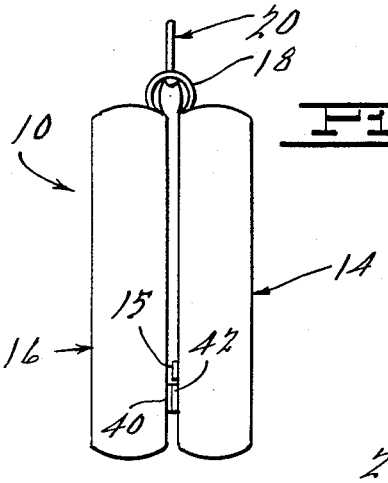
FIG. 6 a side elevation view of a portable cushion apparatus according to the present invention.

FIG. 3 also illustrates a pair of Velcro strips 40 and 42 which are sewn to the backs of each of the cushions 14 and 16. In the embodiment illustrated, the Velcro strip 40 is the strip of flexible loops, while the Velcro strip 42 is the strip of flexible hooks. As illustrated in FIG. 6, the Velcro strips 40 and 42 will become releasably fastened together when the back surfaces of the cushions 14 and 16 are positioned into engagement with each other. Accordingly, the Velcro strips 40 and 42 serve to join the cushions 14 and 16 together at an end generally opposite to that of the piece of flexible material 18.

Figure 8:
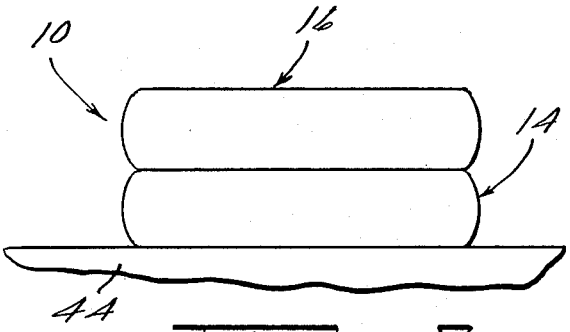
FIG. 8 is an end elevation view of a portable cushion apparatus in a double cushion position on a typical bench seat.

It will be appreciated by those skilled in the art that the Velcro fastener 40–42 provides the cushion apparatus 10 with a compactness which will facilitate the carrying of the cushion apparatus by the handle 20 thereof. This Velcro fastener will also serve to keep the two cushions 14 and 16 aligned together when it is desired to use both of the cushions as a double cushion. An example of a double cushion configuration is shown in the FIG. 8, which shows both of the cushions together on a bench seat 44. The releasable nature of this Velcro fastener will, of course, also permit easy and convenient separation of the two cushions 14 and 16 when desired. Thus, for example, the double cushion configuration shown in FIG. 8 may be quickly converted to the configuration shown in FIG. 2, which will permit two persons to share the cushion apparatus.

Figure 7:
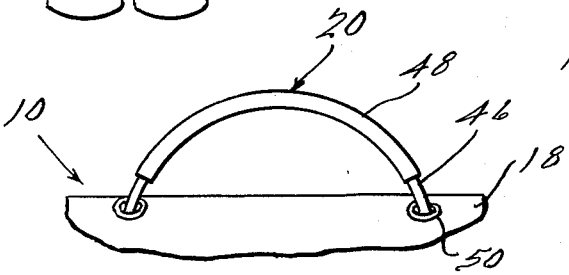
FIG. 7 is a partial perspective view of a portable cushion apparatus according to the present invention which particularly illustrates a handle construction.

Referring to FIG. 7, a partial perspective view of the portable cushion apparatus is shown. This figure particularly illustrates the construction of one embodiment of a handle according to the present invention. In the embodiment, the handle 20 generally comprises a length of rope 46 which is concentrically disposed in a plastic tube 48. The ends of the rope 46 are inserted through a pair of spaced eyelets in the piece of flexible material 18 and knotted. Each of these eyelets are peferably supported or reinforced with a metal grommet 50.

Referring to FIG. 9, a perspective view of the portable cushion apparatus 10 is shown to be contained in a generally transparent plastic bag 52. The plastic bag 52 provides a convenient dust cover for the cushion apparatus 10. One end of the plastic bag 52 at its opening may be inserted through the handle 20 and suitably secured to the other side of the plastic bag as desired, such as by a releasable seal. It will be appreciated that the plastic bag 52 will facilitate storage of the portable cushion apparatus 10 both before and after purchase.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

I claim:

1. A portable cushion apparatus, comprising a pair of flexible enclosures each having resilient material disposed therein, one adapted to form a seat cushion and the other adapted to form either another seat cushion or a back cushion in cooperation with the one seat cushion, flexible means for joining together said flexible enclosures at generally one end thereof for folding of said cushions between an abutting, carrying position and either a parallel side by side relation as a pair of seat cushions or in perpendicular relation to form seat and back cushions, handle means connected to said flexible means for facilitating the carrying of said cushion apparatus, said flexible means having sufficient extent to permit said cushions to directly abut each other when positioned in their perpendicular relationship so that a user sitting thereon will not feel said handle means, and means for releasably joining together said flexible enclosures at generally the end of said flexible enclosures opposite to said flexible means.

2. The portable cushion apparatus according to claim 1, wherein said means for releasably joining together said flexible enclosures comprises hook and loop fastener means.

3. The portable cushion apparatus according to claim 1, wherein said handle means comprises a length of rope concentrically disposed in a plastic tube, the ends of said rope having been inserted through a pair of spaced eyelets in said flexible means and knotted.

4. The portable cushion apparatus according to claim 3, wherein said eyelets in said flexible means are each reinforced with a grommet.

5. The portable cushion apparatus according to claim 1, wherein each of said flexible enclosures includes a re-closable opening.

6. The portable cushion apparatus according to claim 5, wherein said re-closable opening comprises a zipper.

7. The portable cushion apparatus according to claim 5, wherein said re-closable opening comprises hook and loop fastener means.

8. The portable cushion apparatus according to claim 1, wherein said cushion apparatus is contained in a generally transparent plastic bag, said transparent plastic bag having an opening through which said cushion apparatus may be passed with the handle means being exposed through the opening in said transparent plastic bag for facilitating carrying of said cushion apparatus within said bag.

* * * * *